US006177137B1

(12) United States Patent
Rantanen

(10) Patent No.: US 6,177,137 B1
(45) **Date of Patent: *Jan. 23, 2001**

(54) METHOD IN FILM TRANSFER COATING AND EQUIPMENT INTENDED FOR CARRYING OUT THE METHOD

(75) Inventor: Rauno Rantanen, Muurame (FI)

(73) Assignee: Valmet Corporation (FI)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/945,008

(22) PCT Filed: Feb. 6, 1997

(86) PCT No.: PCT/FI97/00071

§ 371 Date: Oct. 7, 1997

§ 102(e) Date: Oct. 7, 1997

(87) PCT Pub. No.: WO97/29239

PCT Pub. Date: Aug. 14, 1997

(30) Foreign Application Priority Data

Feb. 7, 1996 (FI) ..... 960560

(51) Int. Cl.[7] ..... B05D 1/28; B05D 3/04; B05C 1/08; B05C 11/06

(52) U.S. Cl. ..... 427/348; 427/315; 427/350; 427/398.4; 427/428; 427/211; 118/249; 118/250; 118/326; 118/501; 118/63; 118/68; 118/69

(58) Field of Search ..... 427/315, 348, 427/350, 398.4, 428, 211; 118/249, 250, 63, 68, 326, 69, 501

(56) References Cited

U.S. PATENT DOCUMENTS

| | | | | |
|---|---|---|---|---|
| 2,176,093 | * | 10/1939 | Merrill | 427/211 |
| 3,397,673 | * | 8/1968 | Mahoney et al. | 118/63 |
| 3,524,758 | * | 8/1970 | Miller | 427/348 |
| 3,917,888 | * | 11/1975 | Beam et al. | 427/433 |
| 4,244,078 | * | 1/1981 | Hughes et al. | 15/302 |
| 5,378,497 | * | 1/1995 | Johnson et al. | 427/211 |
| 5,483,873 | * | 1/1996 | Koivukunnas et al. | 100/38 |

FOREIGN PATENT DOCUMENTS

| | | | |
|---|---|---|---|
| 90266 | | 5/1993 | (FI) . |
| 95061 | | 9/1994 | (FI) . |
| 93243 | | 11/1994 | (FI) . |
| 1419442 | * | 12/1975 | (GB) . |
| 58-169591 | | 10/1983 | (JP) . |
| 63-22000 | | 1/1988 | (JP) . |

OTHER PUBLICATIONS

J.M. Gess, "Measurement of Sizing", Tappi Papermakers Conference (Chicago) Proceedings pp. 199–200. Apr. 11–13, 1988.

* cited by examiner

*Primary Examiner*—Shrive Beck
*Assistant Examiner*—Michael Barr
(74) *Attorney, Agent, or Firm*—Steinberg & Raskin, P.C.

(57) ABSTRACT

Method and arrangement for coating a web in a film press nip defined by a pair of rotating rolls and through which the web runs and in which a coating agent is applied as a film onto a face of at least one of the rolls and transferred in the nip from the face of the roll(s) onto a respective side of the web to thereby coat the respective side of the web. Steam jets are applied to each side of the web that is being coated to prevent formation of coating-agent mist at a web-outlet side of the nip. The steam jets can be directed from a location after the nip to the web-outlet side of the nip and/or substantially to a point of separation of the web from contact with the roll(s).

22 Claims, 4 Drawing Sheets

METHOD IN FILM TRANSFER COATING AND EQUIPMENT INTENDED FOR CARRYING OUT THE METHOD

FIELD OF THE INVENTION

The invention concerns a method in film transfer coating, in which the coating agent is applied as a film onto the face of at least one of the rolls that form a film press nip, from which roll face the coating agent is transferred in the nip between the rolls onto the paper or board web running through the nip.

Further, the invention concerns an equipment intended for carrying out the method in film transfer coating in connection with a film transfer press, which film transfer press comprises a film press nip formed by a pair of rolls, through which nip the paper or board web is passed, and which film transfer press is provided with coating devices for spreading a coating agent as a film onto the face of at least one of the rolls that form the film press nip, from which roll face the coating agent is arranged to be transferred in the nip between the rolls onto the paper or board web.

BACKGROUND OF THE INVENTION

By means of the film transfer technique, in film size presses the application of a size or paste onto the paper is carried out so that, depending on whether one side or both sides of the paper are supposed to be coated, coating agent films of the desired thickness are spread onto the face or faces of one or both of the rolls in the film size press by means of applicator devices, in which connection these coating agent films are transferred onto the paper web in the nip formed by the size press rolls as the paper web runs through said nip. As a rule, the film rolls in the film size presses are provided with resilient coatings, and the application onto the roll face can be carried out by using some prior-art blade coater, a bar coater provided with a smooth or grooved coating bar, or an equivalent nozzle equipment. At present, in paper machines and, thus, also in the related film size presses, ever higher speeds are aimed at, in which connection in particular this increased speed in size film presses has provided a new problem, i.e., in particular when running takes place with large coating quantities, formation of mist of the coating agent occurs at the outlet side of the press nip. The formation of mist in itself would not be a major problem, but a problem arises when this mist gathers on the constructions of the machine and drips from there onto the paper web and spoils the paper quality, or when the mist spreads into the air in the room. Since the problem has been encountered with higher significance only with increased web speeds, in the prior art at least substantially significant solutions have not been suggested for elimination of this problem.

Indeed, there are some prior-art solutions, and of them can be mentioned, for example, the FI Patent No. 90,266, in whose solution attempts have been made to prevent formation of mist by using a particular hood construction. Similarly, in the FI Patent No. 93,243 a solution is suggested in which the formation of mist in itself is not prevented, but this mist is recovered, or at least attempts are made to recover the mist, by means of mechanical devices fitted at the outlet side of the nip, so that the mist should not have access to other constructions. Thus, this earlier publication does not provide a solution for the formation of mist itself either.

OBJECTS AND SUMMARY OF THE INVENTION

The object of the present invention is to provide a method by whose means, in the film size press, formation of mist of coating agent and problems arising from same are avoided. In view of achieving this object, the method in accordance with the invention is mainly characterized in that, in the coating process, formation of coating-agent mist is prevented at the outlet side of the film press nip so that steam jets are applied at least to the side of the web that is being coated.

The equipment in accordance with the invention is mainly characterized in that, in connection with the film transfer press, steam supply devices are provided so as to apply steam jets at least to the side of the web that is being coated in order to prevent formation of coating-agent mist at the outlet side of the film press nip in connection with the coating process.

It is the most important advantage of the present invention over the prior-art solutions that, in the invention, in itself, attempts are not made just to prevent spreading of mist, but instead, attempts are made to prevent formation of mist completely. When no mist is formed at all, it does, consequently, not constitute problems either. The formation of mist is prevented in the present invention by means of spraying of steam, which provides the additional advantage that, by means of said steam jets, the web is supported and, thus, fluttering of the web is prevented, and it has been noticed that said fluttering in itself causes formation of mist. Further advantages and characteristic features of the invention will come out from the following detailed description of the invention.

BRIEF DESCRIPTION OF THE DRAWINGS

In the following, the invention will be described by way of example with reference to the figures in the accompanying drawing.

DETAILED DESCRIPTION OF THE PREFERRED EMBODIMENTS

Figure 1:
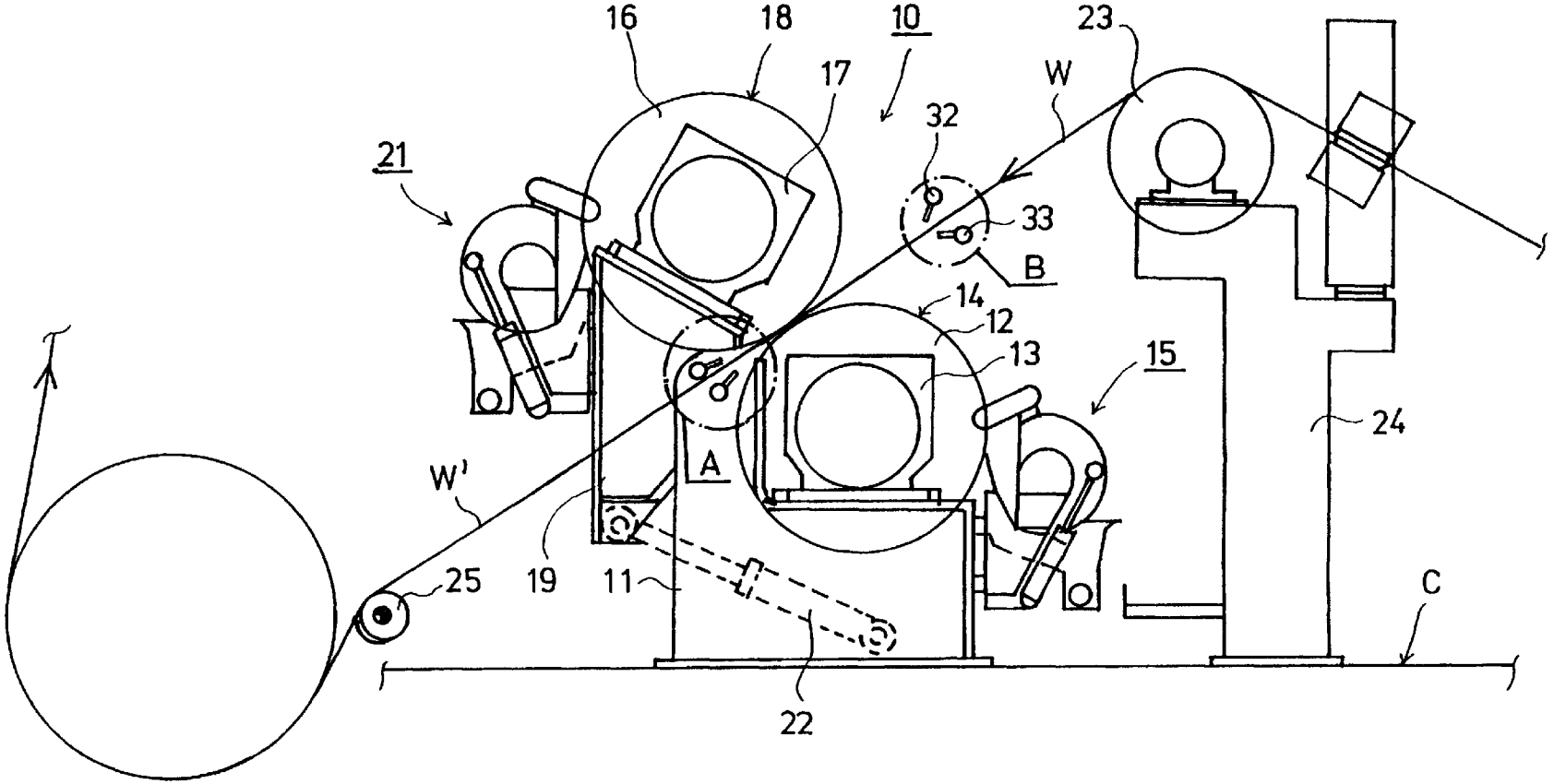
FIG. 1 is a fully schematic side view of a film press in which the method in accordance with the present invention is utilized.

In FIG. 1, the film press is denoted generally with the reference numeral 10. The film press 10 comprises a film press frame 11 mounted on a foundation C, on which frame 1 the film press rolls 12,16 are mounted in a conventional way. The bearing housing 13 of the first film press roll, i.e. the lower roll, is mounted directly on the frame 11 of the film press and attached to the frame rigidly. On the other hand, the bearing housing 17 of the second film press roll, i.e. the upper roll, is mounted on a loading arm 19, which is linked pivotally on the film press frame 11 by means of a pivot shaft placed in the cross direction of the machine. Between the loading arm 19 and the film press frame 11, loading cylinders 22 are fitted, by whose means the loading arm 19 is loaded in order to produce a nip pressure of the desired extent in the nip N formed by the lower roll 12 and the upper roll 16. Either one of the film press rolls 12,16, preferably the upper roll 16, or, alternatively, both of the film press rolls 12,16 can be variable-crown rolls in order that the nip N pressure could be brought to the desired level in the cross direction of the machine. In the solution shown in FIG. 1, each film press rolls 12,16 is provided with coating means

15,21, by whose means the size films or equivalent coating agent films are spread and smoothed onto the faces 14,18 of said rolls. Of course, it is fully obvious that, if the web W supposed to be coated from one side only, the film press roll placed at the corresponding side of the web W is provided with a coating device, in which case the film press roll at the opposite side is not coated.

In the solution shown in FIG. 1, when the web W runs through the nip N, the coating agent films are transferred from the roll 12,16 faces 14,18 onto the web W'. The web W is passed into the film press nip N over a guide roll 23, which is mounted on a stationary frame 24 mounted on the foundation C. After the film press nip N, the web W' is passed over a spreader roll 25 to further processing. The construction and the operation of the coating devices 15,21 are not described in detail in this connection, because they can be conventional, known from the prior art, and, thus, they do not constitute a part of the present invention. Nor will the means of support of the spreader roll 25 be described in more detail in this connection. In particular in pigment coating, after the film size press, as a rule, airborne web dryers are employed before a drying cylinder.

The method in accordance with the present invention is based on supply of steam onto the web W, and most advantageously the steam is supplied as steam jets to the outlet side of the nip N. This is seen in FIG. 1 in the area A and in more detail in FIG. 2. Steam can also be supplied onto the web W before the nip N, as is shown in the area B in FIG. 1. This will be reverted to briefly later.

Figure 2:
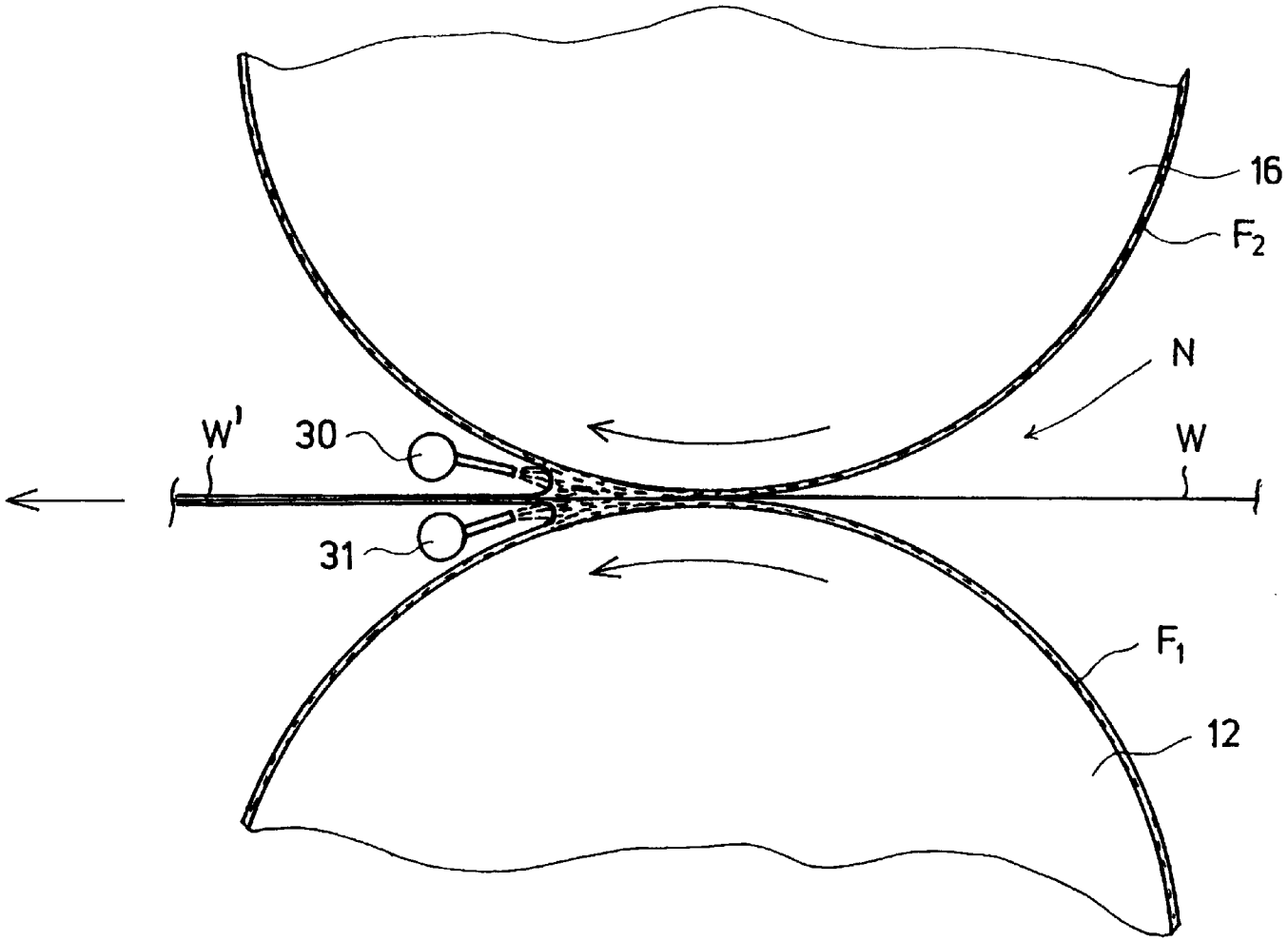
FIG. 2 is a schematic illustration of an enlarged detail from the area A in FIG. 1.

As was already described above in relation to FIG. 1, in film press coating, the coating agent is applied as films $F_1$,$F_2$ onto the faces of the film press rolls 12,16 that form the nip N, and the web W is passed through said film press nip N, in which connection, in the nip, the coating agent films $F_1$,$F_2$ are substantially transferred onto the web W', as is illustrated in FIG. 2. Further, as was described above, in particular new and high-speed machines involve the problem that, in particular when running takes place at high speeds and with large coating quantities, at the outlet side of the film press nip N formation of coating-agent mist occurs. Thus, in the present invention, this problem has been solved so that, at least at the outlet side of the nip N, at least on the side of the web W' that is supposed to be coated, steam supply means 30,31 are provided, from which steam jets are passed after the nip N to the point of separation between the web W' and the roll 12,16. With this procedure, it has been possible to exclude formation of mist completely, even though it is not known exactly what this elimination of mist is based on.

Concerning this, a number of different alternative theories can be presented, whose correctness has not been proved with certainty. According to one theory, the steam "condenses" the mist onto the web W'. A theory has also been presented according to which, in the steam phase, the film splitting filaments are shorter because of the difference in surface energy between air and steam. Further, it has been suggested that the steam jet stabilizes the web separation line. Further, it has been suggested that the steam raises the temperature of the roll face or forms an aqueous film on the roll face, in which connection the splitting of the film is facilitated.

As was stated above, it has not been possible to present a fully reliable theory concerning the prevention of mist formation, but, in any case, it has been established with certainty, with a great surprise, that passing of steam jets to the outlet side of the nip N to the point of separation between the web W' and the roll 12,16 makes the mist disappear.

With reference to FIG. 1 above, the further possibility is provided that the web W can already be steam-treated before the nip N. In this way the temperatures of the films $F_1$,$F_2$ could be made higher, which in itself would reduce the mist formation. In FIG. 1 it is illustrated schematically that the steam supply means 32,33 placed before the nip N are placed quite far before the nip N. It might, however, be preferable that said devices are placed in direct vicinity of the nip N, in which case the steam jets could be directed either at the web W, at the coating agent films present on the faces 14,18 of the film press rolls, or directly into the nip N, i.e. into the gap between the roll face 18/14 and the web W. The primary solution is, however, that shown in more detail in FIG. 2, i.e. spraying of steam to the outlet side of the nip.

Figure 3A:
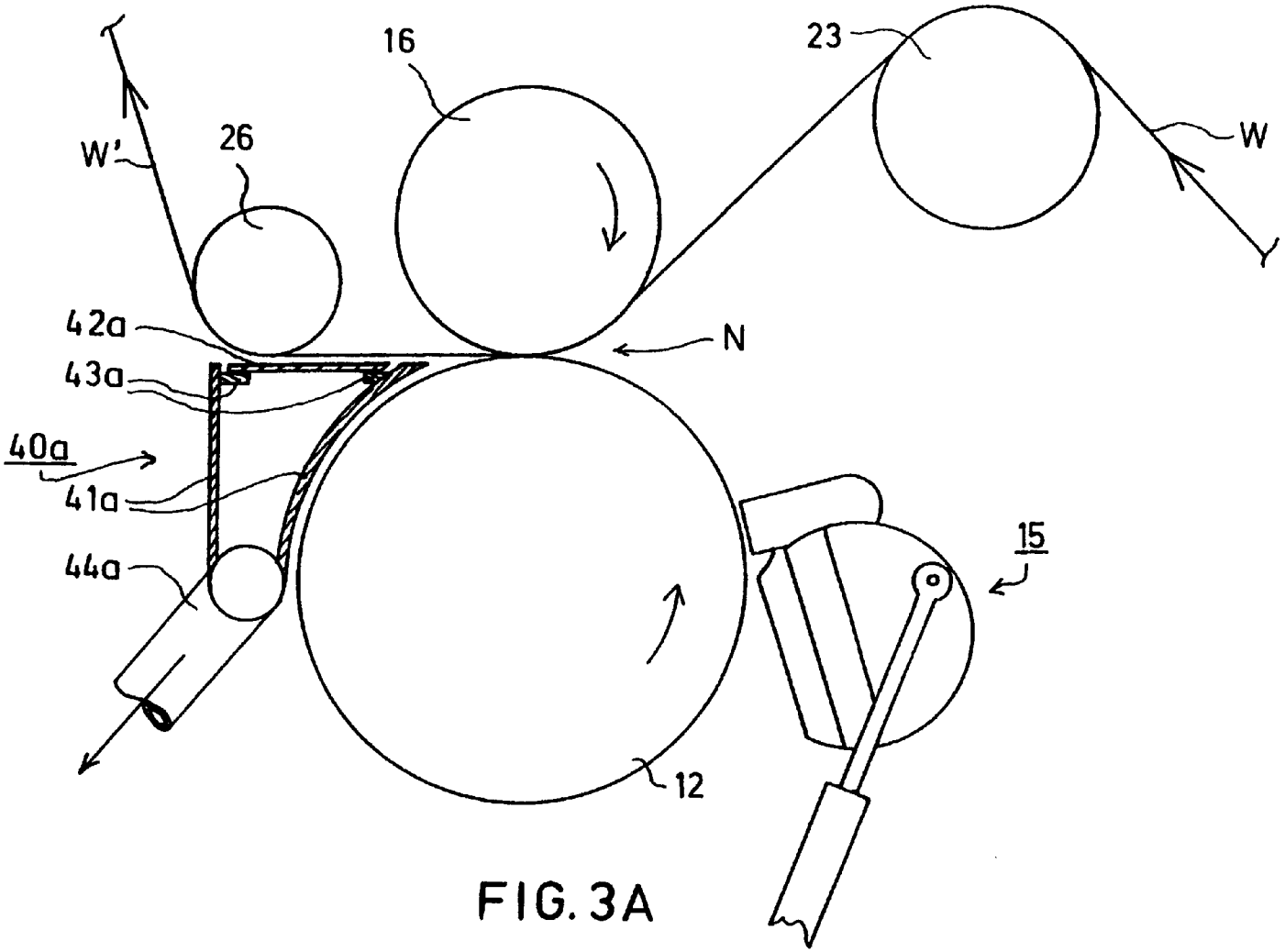
FIGS. 3A and 3B are schematic illustrations of further embodiments of the invention, applied to single-sided coating of the web.
Figure 3B:
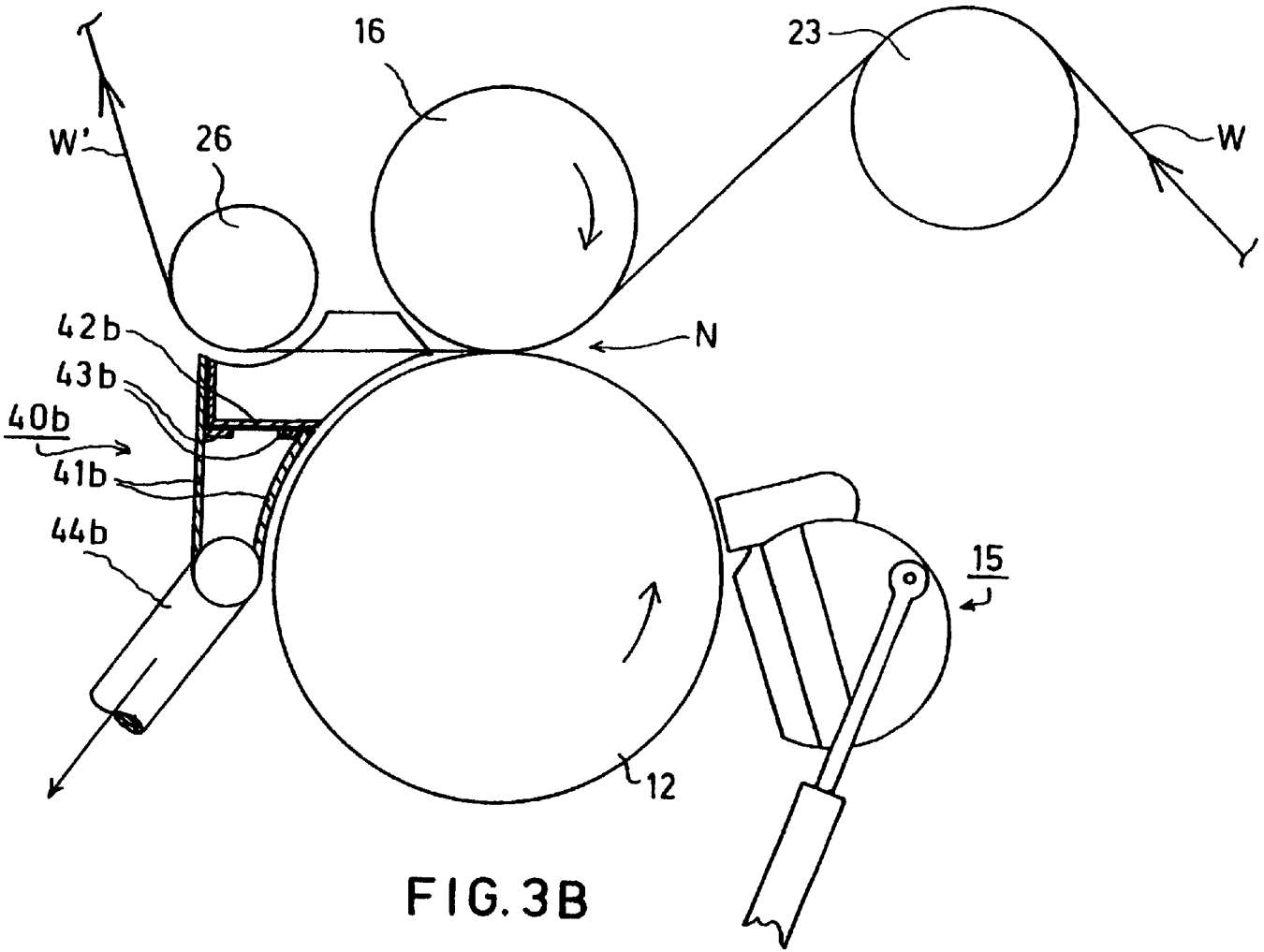

FIGS. 3A and 3B show further embodiments of the invention, which embodiments are, in the illustrations in the figures, applied to single-sided coating of the web. In the solutions as shown in these figures, a coating device 15 has been fitted in connection with one roll 12 only, of the rolls that form the film press nip N, which coating device applies a film of coating agent onto the face of said roll 12. In said exemplifying embodiments, at the outlet side of the nip N, a collecting equipment 40*a*,40*b* is fitted, which is supposed to prevent spreading of steam or coating-agent mist that may possibly have been formed in the coating process into the air in the room. The embodiments shown in FIGS. 3A and 3B are highly similar to one another, so that, in the following, they will be examined together. The collecting equipment 40*a*,40*b* comprises a basin or trough provided with walls 41*a*,41*b*, which basin or trough is, as is shown in the figures, preferably fitted in the gap between the web W and the roll 12 provided with a coating device 15, at the outlet side of the nip N. The collecting equipment 40*a*,40*b* is fitted at a very short distance from said roll 12, preferably so that the wall of the collecting equipment 40*a*,40*b* placed towards the roll 12 passes along the roll 12 face. The collecting equipment 40*a*,40*b* is connected with a suction duct 44*a*,44*b*, through which a suction and at least a partial vacuum are applied to the collecting equipment 40*a*,40*b*, so that, by the effect of said vacuum, the steam and the coating-agent mist are gathered in the collecting trough. Further, the collecting equipment 40*a*,40*b* is supposed to take advantage of the condensation effect, and therefore preferably at least one of the walls of the collecting equipment 40*a*,40*b* is provided with cooling. Further, the collecting equipment 40*a*,40*b* is provided with a top cover 42*a*,42*b*, which is fitted in the vicinity of the web W. In the exemplifying embodiment shown in FIG. 3B, the top cover 42*b* is further provided with sides extending above the edges of the web W, and in partial opposed relationship to a roll 26 over which the web is guided. The top cover 42*a*,42*b* is arranged to be displaceable and adjustable in the lateral direction in compliance with the web width. Therefore, the collecting equipment 40*a*,40*b* is provided with guides 43*a*,43*b*, along which the top cover 42*a*,42*b* can be displaced.

Since, in the coating process, the formation of the coating-agent mist takes place expressly at the outlet side of the nip N, it is fully possible to use a collecting equipment 40*a*,40*b* as shown in FIGS. 3A and 3B alone to collect and to dispose of the coating-agent mist that has been formed, without the supply of steam onto the web W that was described above. Even by means of the collecting equipment 40*a*,40*b* alone, it is possible to reduce the coating-agent mist at least substantially. Of course, it is possible and even advantageous to make use of the collecting equipment as shown in FIGS. 3A and 3B in connection with the supply of steam, in which case the formation of coating-agent mist can be excluded most efficiently.

Above, the invention has been described by way of example with reference to preferred exemplifying embodiments of the invention illustrated in the figures in the accompanying drawing. The invention is, however, not confined to the exemplifying embodiments shown in the figures alone, but different embodiments of the invention can show variation within the scope of the inventive idea defined in the accompanying patent claims.

What is claimed is:

1. In a method for coating a web in a film press nip defined by a pair of rotating rolls and through which the web runs and in which a coating agent is applied as a film onto a face of at least one of the rolls and transferred in the nip from the face of the at least one roll onto a respective side of the web to thereby coat the respective side of the web, the improvement comprising the step of:

applying steam jets over the entire width of the web as well as on each side of the web that is being coated, said steam jets being directed at the separation point of the coating agent film from the web to prevent formation of coating-agent mist at a web-outlet side of the nip as a result of the coated web separating from the rolls as well as from the fluttering of the coated web as the coated web exits the nip.

2. The method of claim 1, wherein the step of applying steam jets to each side of the web that is being coated comprises the step of directing the steam jets from a location after the nip to the web-outlet side of the nip.

3. The method of claim 1, wherein the step of applying steam jets to each side of the web that is being coated comprises the step of directing the steam jets from a location after the nip substantially to a point of separation of the web from contact with the at least one roll.

4. The method of claim 1, wherein the step of applying steam jets to each side of the web that is being coated comprises the step of directing steam onto the respective side of the web at a location before the nip in order to raise the temperature of the film of coating agent transferred onto the respective side of the web.

5. The method of claim 4, wherein said step of directing steam onto the web comprises the step of directing steam jets at the face of the roll or directly at the web.

6. The method of claim 4, wherein said step of directing steam onto the web comprises the step of directing steam jets substantially directly into the nip through a gap between the roll and the web on the respective side of the web.

7. The method of claim 1, wherein the coating agent is applied as a film onto the face of both rolls and transferred in the nip from the face of each roll onto the respective side of the web to thereby coat both sides of the web such that steam jets are applied to both sides of the web.

8. The method of claim 1, further comprising the step of:

preventing spreading of steam and coating-agent mist arising during the transfer of the coating agent film onto the web in the nip by arranging a collecting member only after the nip, applying suction through said collecting member to draw the steam and coating agent mist away from the web and causing condensation of the steam and coating-agent mist on said collecting member to form condensate water on said collecting member.

9. The method of claim 8, wherein said collecting member is defined by at least one wall, said step of causing condensation of the steam and coating-agent mist on said collecting member comprising the step of cooling said at least one wall.

10. The method of claim 8, further comprising the step of:

generating a vacuum in said collecting member to draw the steam and coating-agent mist into said collecting member and to remove the steam, coating-agent mist and condensate water from said collecting member.

11. In a method for coating a web in a film press nip defined by a pair of rotating rolls and through which the web runs in which a coating agent is applied as a film onto a face of at least one of the rolls and transferred in the nip from the face of the at least one roll onto a respective side of the web to thereby coat the respective side of the web, the improvement comprising the step of:

causing condensation of steam and coating-agent mist on a collecting member, preventing spreading of steam, condensate and coating-agent mist arising during the separation of the coated web from the roll in the nip by arranging a collecting member only after the nip, and applying suction through said collecting member to draw the steam, condensate and coating agent mist away from the web.

12. The method of claim 11, further comprising the step of:

directing the web in a straight run after the nip, wherein said collecting member is defined by at least one straight wall arranged substantially perpendicular to the straight run of the web, said step of causing condensation of the coating-agent mist on said collecting member comprising the step of cooling said at least one wall.

13. The method of claim 11, further comprising the step of:

generating a vacuum in said collecting member to draw the coating-agent mist into said collecting member and to remove the coating-agent mist and condensate water from said collecting member.

14. In an arrangement for coating a web in a film press nip defined by a pair of rolls and through which the web runs and including application means for applying a coating agent as a film onto a face of at least one of said rolls, the coating agent film being transferred in the nip from the face of said at least one roll onto a respective side of the web to thereby coat the respective side of the web, the improvement comprising:

steam supply means for applying steam onto each side of the web that is being coated directed along the entire width of the web at the point of separation of the web from said roll in order to prevent formation of coating-agent mist at a web-outlet side of the nip.

15. The arrangement of claim 14, wherein said steam supply means are arranged at the web-outlet side of the nip and apply steam onto the web after the nip.

16. The arrangement of claim 14, wherein said steam supply means are arranged at a location before the nip and apply steam onto the web before the nip in order to steam-treat the web and raise the temperature of the coating agent film transferred onto the respective side of the web.

17. The arrangement of claim 16, wherein said steam supply means are arranged to direct jets of steam onto the face of said at least one roll or directly onto the web.

18. The arrangement of claim 16, wherein said steam supply means are arranged to direct jets of steam directly into the nip through a gap between said at least one roll and the web on the respective side of the web.

19. The arrangement of claim 14, wherein both sides of the web are coated and said steam supply means are arranged to apply steam to both sides of the web.

20. The arrangement of claim 14, further comprising a collecting member arranged after the nip, suction means coupled to said collecting member for applying a vacuum in said collecting member to draw steam and coating agent mist into said collecting member, and condensation means for causing condensation of steam and coating agent mist on said collecting member.

21. The arrangement of claim 20, wherein said collecting member comprises at least one wall arranged in opposed relationship to and at a distance from one of said rolls, and a cover member arranged at a distance from the web, said at least one wall being cooled to thereby constitute said condensation means.

22. The arrangement of claim 21, wherein said cover member is displaceable in the cross direction to provide said collecting member with a width corresponding to the width of the web.

* * * * *